US006471484B1

(12) United States Patent
Crall

(10) Patent No.: US 6,471,484 B1
(45) Date of Patent: Oct. 29, 2002

(54) METHODS AND APPARATUS FOR DAMPING ROTOR ASSEMBLY VIBRATIONS

(75) Inventor: David William Crall, Loveland, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/844,207

(22) Filed: Apr. 27, 2001

(51) Int. Cl.[7] ..... F01D 5/16

(52) U.S. Cl. ..... 416/229 R; 416/229 A; 416/500

(58) Field of Search ..... 416/229 R, 230, 416/229 A, 241 R, 500; 29/889.2, 889.21

(56) References Cited

U.S. PATENT DOCUMENTS

| | | | | |
|---|---|---|---|---|
| 3,796,513 A | * | 3/1974 | Jonas | 416/224 |
| 5,226,784 A | | 7/1993 | Mueller et al. | |
| 5,302,085 A | | 4/1994 | Dietz et al. | |
| 5,356,264 A | * | 10/1994 | Watson et al. | 415/119 |
| 5,369,882 A | | 12/1994 | Dietz et al. | |
| 5,498,137 A | * | 3/1996 | El-Aini et al. | 416/229 A |
| 5,725,355 A | * | 3/1998 | Crall et al. | 416/229 A |
| 5,785,499 A | | 7/1998 | Houston et al. | |
| 5,820,343 A | | 10/1998 | Kraft et al. | |
| 5,820,346 A | | 10/1998 | Young et al. | |
| 5,827,047 A | | 10/1998 | Gonsor et al. | |
| 6,039,542 A | * | 3/2000 | Schilling et al. | 416/233 |
| 6,155,789 A | | 12/2000 | Mannava et al. | |
| 6,171,058 B1 | | 1/2001 | Stec | |
| 6,193,465 B1 | | 2/2001 | Liotta et al. | |
| 6,299,410 B1 | * | 10/2001 | Hilbert et al. | 416/145 |

FOREIGN PATENT DOCUMENTS

JP 2000130102 A * 5/2000

* cited by examiner

*Primary Examiner*—Edward K. Look
*Assistant Examiner*—Ninh Nguyen
(74) *Attorney, Agent, or Firm*—Rodney M. Young; Armstrong Teasdale LLP

(57) ABSTRACT

A multi-stage rotor assembly for a gas turbine engine includes a damper system that facilitates damping vibrations induced to the rotor assembly. The rotor assembly includes a blisk rotor including a plurality of rotor blades and a radially outer rim. The rotor blades are integrally formed with the rim and extend radially outward from the rim. The damper system is attached to rotor blades within at least one stage of the rotor assembly, and includes at least one layer of damping material and a cover sheet. The cover sheet is attached to the rotor blade with adhesive.

19 Claims, 3 Drawing Sheets

METHODS AND APPARATUS FOR DAMPING ROTOR ASSEMBLY VIBRATIONS

STATEMENT REGARDING FEDERALLY SPONSORED RESEARCH & DEVELOPMENT

The government has rights in this invention pursuant to Contract No. F33615-96-C-2657 awarded by the Department of the Air Force.

BACKGROUND OF THE INVENTION

This invention relates generally to rotor assemblies and, more particularly, to damper systems for damping vibrations induced to the rotor assemblies.

A gas turbine engine typically includes at least one rotor including a plurality of rotor blades that extend radially outwardly from a common annular rim. Specifically, in blisk rotors, the rotor blades are formed integrally with the annular rim rather than attached to the rim with dovetail joints. An outer surface of the rim typically defines a radially inner flowpath surface for air flowing through the rotor assembly.

Centrifugal forces generated by the rotating blades are carried by portions of the rims below the rotor blades. The centrifugal forces generate circumferential rim stress concentration between the rim and the blades that may be induced through the blades. Additionally, within blisk rotors, because of an absence of friction damping created when dovetails and shrouds contact each other during operation, vibrational stresses may be induced to the rotor assembly.

To facilitate vibration damping, rotor assemblies may include dampers. At least some known rotor assemblies include sleeve dampers positioned beneath the rim to damp airfoil modes. The sleeve dampers provide damping to airfoil modes that have significant rim participation.

At least some other known rotor assemblies include rotor blades including pockets formed within the blades. A layer of damper material is embedded in the pocket and covered with a titanium constraining layer. The pocket is covered with a titanium cover that is welded to the rotor blade. During operation, forces induced within the rotor blade may cause the constraining layer to separate from the damper material and forcibly contact the cover. Over time, continued contact between the constraining layer and the cover sheet may cause the cover sheet to separate from the rotor blade.

BRIEF SUMMARY OF THE INVENTION

In an exemplary embodiment, a multi-stage rotor assembly for a gas turbine engine includes a damper system for facilitating damping vibrations induced to the rotor assembly. More specifically, the rotor assembly includes a blisk rotor including a plurality of rotor blades and a radially outer rim. The rotor blades are integrally formed with the outer rim and extend radially outward from the rim. The damper system is attached to the rotor blades forming at least one stage of the rotor assembly, and includes at least one layer of damping material and a cover sheet. The cover sheet is attached to the rotor blade with adhesive to secure the damping material against the rotor blade.

During operation, as the rotor assembly rotates, the adhesive placed between the cover sheets and the rotor blades carries centrifugal loads induced through the rotor blades. Vibration damping is facilitated by the damper system. More specifically, as the rotor assembly rotates, shear strains induced into the damper material facilitate vibration damping. As a result, the damper assembly facilitates damping vibrations induced to the rotor assembly in a reliable and cost-effective manner.

DETAILED DESCRIPTION OF THE INVENTION

Figure 1:
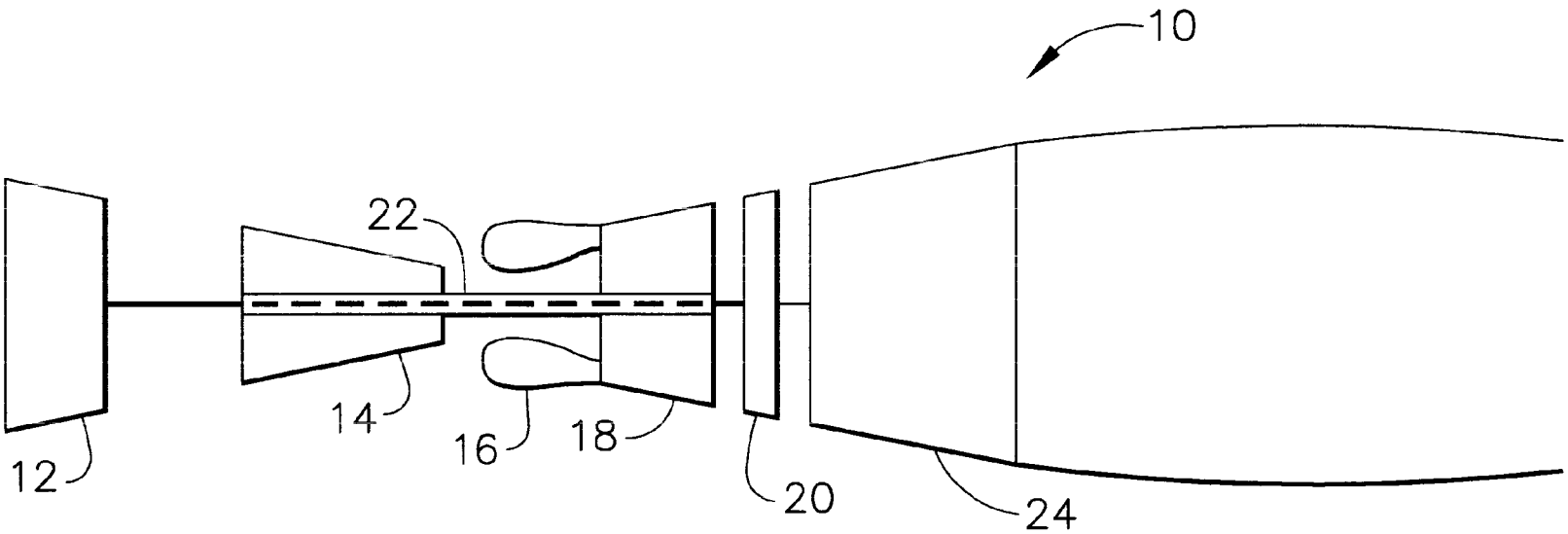
FIG. 1 is a schematic illustration of a gas turbine engine.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20. Compressor 12 and turbine 20 are coupled by a first shaft 21, and compressor 14 and turbine 18 are coupled by a second shaft 22. In one embodiment, gas turbine engine 10 is an F110 engine commercially available from General Electric Aircraft Engines, Cincinnati, Ohio.

In operation, air flows through low pressure compressor 12 and compressed air is supplied from low pressure compressor 12 to high pressure compressor 14. The highly compressed air is delivered to combustor 16. Airflow from combustor 16 drives turbines 18 and 20 and exits gas turbine engine 10 through a nozzle 24.

Figure 2:
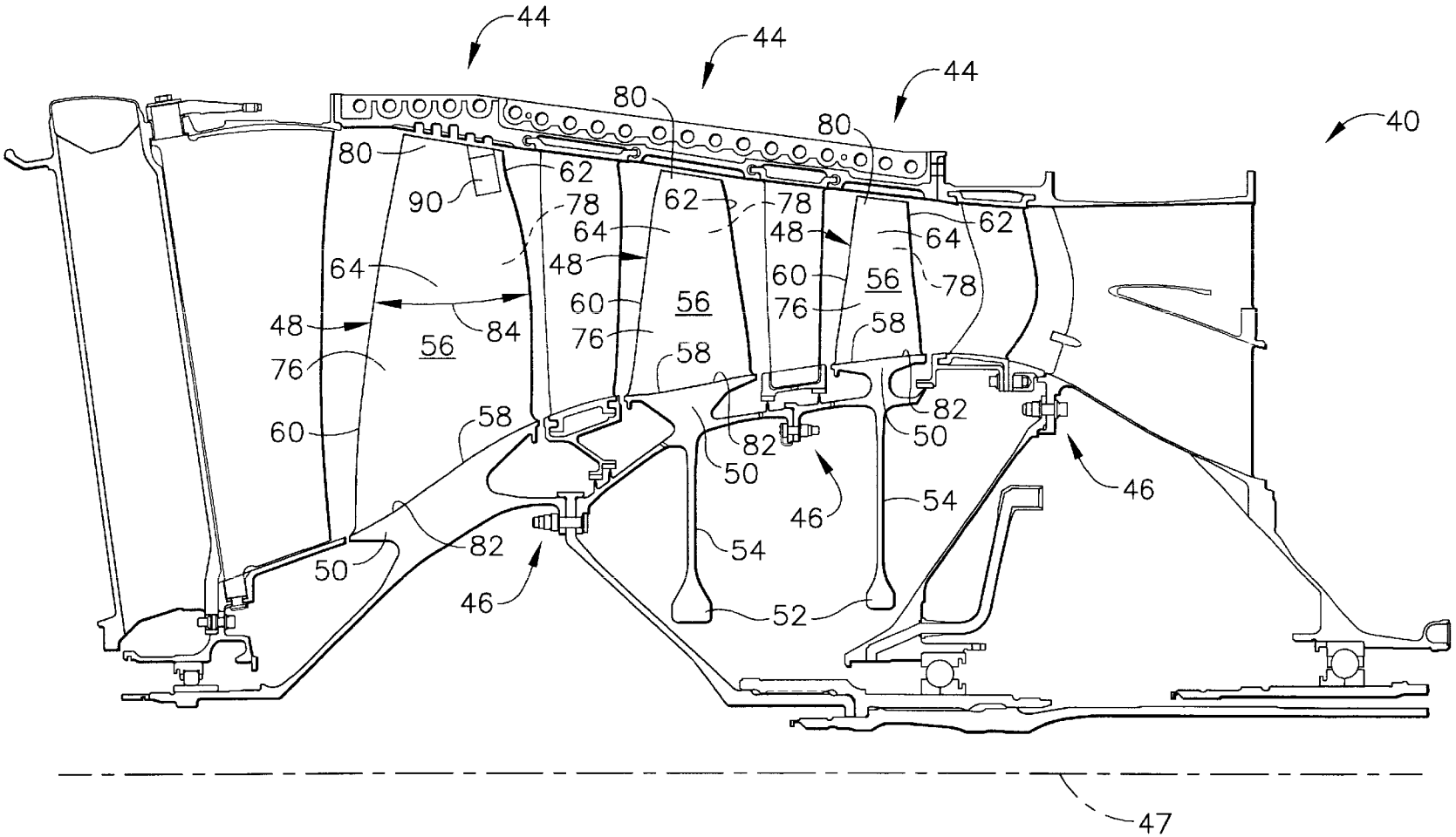
FIG. 2 is a partial cross-sectional view of a rotor assembly including a damper system and that may be used with the gas turbine engine shown in FIG. 1.

FIG. 2 is a partial cross-sectional view of a rotor assembly 40 that may be used with gas turbine engine 10. Rotor assembly 40 includes a plurality of rotors 44 joined together by couplings 46 co-axially about an axial centerline axis 47. Each rotor 44 is formed by one or more blisks 48, and each blisk 48 includes an annular radially outer rim 50, a radially inner hub 52, and an integral web 54 extending radially therebetween. Each blisk 48 also includes a plurality of blades 56 extending radially outwardly from outer rim 50. Blades 56, in the embodiment illustrated in FIG. 2, are integrally joined with respective rims 50. Alternatively, and for at least one stage, each rotor blade 56 may be removably joined to rims 50 in a known manner using blade dovetails (not shown) which mount in complementary slots (not shown) in a respective rim 50.

Rotor blades 56 are configured for cooperating with a motive or working fluid, such as air. In the exemplary embodiment illustrated in FIG. 2, rotor assembly 40 is a compressor of gas turbine engine 10, with rotor blades 56 configured for suitably compressing the motive fluid air in succeeding stages. Outer surfaces 58 of rotor rims 50 define a radially inner flowpath surface of the compressor as air is compressed from stage to stage.

Blades 56 rotate about the axial centerline axis up to a specific maximum design rotational speed, and generate centrifugal loads in rotating components. Centrifugal forces generated by rotating blades 56 are carried by portions of rims 50 directly below each rotor blade 56. Rotation of rotor assembly 40 and blades 56 imparts energy into the air which is initially accelerated and then decelerated by diffusion for recovering energy to pressurize or compress the air. The radially inner flowpath is bound circumferentially by adjacent rotor blades 56 and is bound radially with a shroud (not shown).

Rotor blades 56 each include a leading edge 60, a trailing edge 62, and an airfoil 64 extending therebetween. Airfoil 64 includes a suction side 76 and a circumferentially opposite pressure side 78. Suction and pressure sides 76 and 78, respectively, extend between axially spaced apart leading and trailing edges 60 and 62, respectively and extend in radial span between a rotor blade tip 80 and a rotor blade root 82. A blade chord 84 is measured between rotor blade trailing and leading edges 62 and 60, respectively.

Each airfoil 64 also includes a damper system 90. In the exemplary embodiment, only first stage rotors 44 include damper system 90. In another embodiment, additional stages of rotors 44 extending through rotor assembly 40 include damper system 90. During operation, as described in more detail below, damper system 90 damps airfoil modes within rotor assembly 40 to facilitate damping vibration induced to rotor assembly 40.

Figure 4:
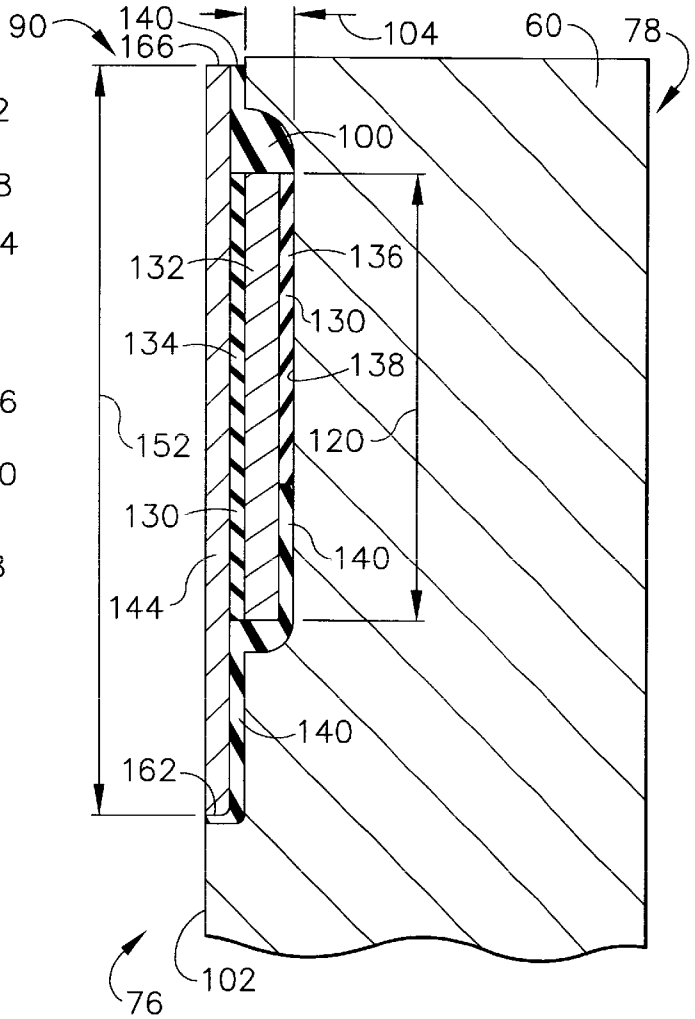
FIG. 4 is a side view of the damper system shown in FIG. 3.
Figure 3:
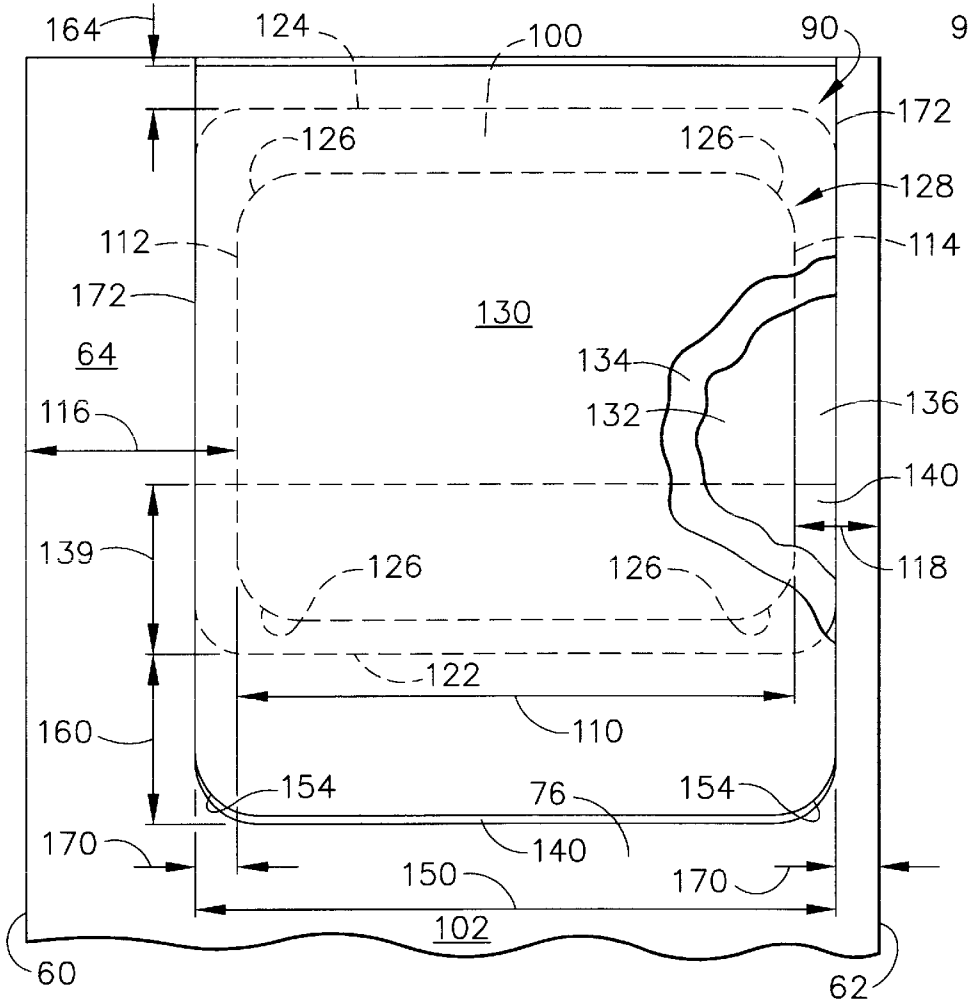
FIG. 3 is an enlarged front view of a portion of the damper system shown in FIG. 2.

FIG. 3 is an enlarged front view of rotor blade airfoil 64 including damper system 90. FIG. 4 is a side view of airfoil 64 and damper system 90. Airfoil 64 includes a pocket cavity 100 extending from an external surface 102 of airfoil body suction side 76 towards airfoil body pressure side 78. In one embodiment, cavity 100 is machined into airfoil 64. More specifically, cavity 100 extends a distance 104 radially inward from airfoil external surface 102. Cavity depth 104 is less than a thickness (not shown) of airfoil 64 measured between airfoil suction side 76 and airfoil pressure side 78.

Cavity 100 has a width 110 measured from a leading edge 112 to a trailing edge 114. Cavity width 110 is smaller than airfoil blade chord 84 such that cavity leading and trailing edges 112 and 114, respectively, are each a respective distance 116 and 118 from airfoil leading and trailing edges 60 and 62. In addition, cavity 100 has a height 120 extending from a bottom edge 122 to a top edge 124 that is less than the radial span of airfoil 64. In the exemplary embodiment, cavity 100 has a substantially rectangular shape including rounded corners 126. Alternatively, cavity 100 is non-rectangular shaped. Cavity leading and trailing edges 112 and 114, respectively, connect with cavity bottom and top edges 122 and 124, respectively, with corners 126, and define an outer periphery 128 of cavity 100.

Damper system 90 includes a plurality of damper material layers 130, a constraining layer 132, and a cover sheet 134. In one embodiment, damping material layers 130 are fabricated from a visco-elastic material (VEM). A first damper material layer 136 is embedded into cavity 100 against a back wall 138 of cavity 100. More specifically, damper material layer 136 is embedded against cavity back wall 138 a distance 139 from cavity bottom edge 122. Adhesive material 140 extends between damper material layer 136 and cavity bottom edge 122.

Constraining layer 132 is inserted within cavity 100 against damper material layer 136. In one embodiment, constraining layer 132 is fabricated from titanium. More specifically, constraining layer 132 extends between cavity top and bottom edges 124 and 122, respectively, and is held in position against damper material layer 136 with adhesive material 140. In one embodiment, adhesive material 140 is AF191 commercially available from 3M Bonding Systems, St. Paul, Minn. 55144. In another embodiment, damper system 90 includes a plurality of constraining layers 132 stacked adjacent to each other and held together with adhesive material 140.

A second damper material layer 144 is embedded into cavity 100 against constraining layer 132. Second damper material layer 144 extends between cavity top and bottom edges 124 and 122, respectively. Accordingly, constraining layer 132 extends between damper material layers 130.

Damper system cover sheet 134 has a width 150 that is wider than cavity width 110, and is narrower than airfoil blade chord 84 (shown in FIG. 2). In one embodiment, damper system cover sheet 134 is fabricated from titanium. Damper system cover sheet 134 also has a height 152 that is taller than cavity height 120, and is shorter than the radial span of airfoil 64. In the exemplary embodiment, damper system cover sheet 134 has a substantially rectangular profile and includes rounded lower corners 154. In an alternative embodiment, damper system cover sheet 134 has a non-rectangular profile.

Damper system cover sheet 134 is attached in sealing contact to rotor blade airfoil 64 with adhesive material 140 extending around cavity periphery 128. More specifically, damper system cover sheet 134 is positioned relative to airfoil cavity 100 such that a distance 160 between a bottom edge 162 of cover sheet 134 and cavity bottom edge 122 is larger than a distance 164 between a top edge 166 of cover sheet 134 and cavity top edge 124. Furthermore, cover sheet 134 is positioned relative to airfoil cavity 100 such that a distance 170 between each side edge 172 of cover sheet 134 and each respective cavity leading and trailing edge 112 and 114, is approximately equal, and less than cover sheet distance 160. In one embodiment, distance 162 is approximately twice as long as distance 164. Because damper system cover sheet 134 is affixed in sealing contact to airfoil 64, cover sheet 134 shields damper material layers 130 from exposure to hot combustion gases flowing through rotor assembly 40.

Adhesive material 140 extends between each respective cavity edge 112, 114, 122, and 124, and each respective cover sheet edge 172, 172, 162, and 166. Accordingly, more adhesive material 140 extends between cavity bottom edge 122 and cover sheet bottom edge 162 than between any other cavity edge 112, 114, and 124, and a respective cover sheet edge 172, 172, and 166.

During operation, as rotor assembly 40 rotates, vibration damping is facilitated by damper material layers 130. More specifically, vibration damping is facilitated by shear strains induced within first damper material layer 136 between airfoil 64 and constraining layer 132, and within second damper material layer 144 between constraining layer 132 and cover sheet 134. Adhesive material 140 placed between cavity bottom edge 122 and cover sheet bottom edge 162 facilitates carrying centrifugal force loading induced into airfoil 64, but does not prohibit first damper material layer 136 from straining during chord-wise bending vibration.

Additionally, during operation, damper system cover sheet 134 prevents constraining layer 132 from separating from damper material layers 130. Further more, because damper system cover sheet 134 is affixed to airfoil 64 with adhesive material 140, during rotation of rotor assembly 40, cover sheet 134 induces shear strains into second damper material layer 144 to facilitate vibration damping within damper system 90.

The above-described rotor assembly is cost-effective and highly reliable. The rotor assembly includes a damper system that facilitates damping vibrations induced to each rotor blade. More specifically, the damper system includes at least one layer of damping material, a constraining layer, and a cover sheet. The constraining layer is affixed within the airfoil cavity with adhesive. The cover sheet is also affixed to the airfoil with adhesive extending around the cavity periphery, such that the cover sheet is in sealing contact with the airfoil. During operation, the adhesive material carries the centrifugal force loading induced to the rotor blade, while shear strains generated within the damping material damp vibrations. As a result, the damper system facilitates damping vibrational forces induced to the rotor assembly.

While the invention has been described in terms of various specific embodiments, those skilled in the art will recognize that the invention can be practiced with modification within the spirit and scope of the claims.

What is claimed is:

1. A method of fabricating a rotor assembly for a gas turbine engine to facilitate damping vibrations induced to the rotor assembly, the rotor assembly including a radially outer rim and a plurality of rotor blades that extend radially outward from the radially outer rim, each of the rotor blades including an airfoil including a pair of opposing sidewalls, said method comprising the steps of:

forming a cavity in each rotor blade airfoil that extends radially inward from the airfoil first sidewall towards the airfoil second sidewall;

embedding a first layer of damping material within the airfoil cavity adjacent the airfoil; and attaching a constraining layer to the airfoil with adhesive, such that the constraining layer is adjacent the first layer of damping material; and attaching a cover sheet to the airfoil with adhesive, such that the cover sheet extends around a periphery of the airfoil cavity in sealing contact with the airfoil.

2. A method in accordance with claim 1 wherein said step of forming a cavity in each rotor blade airfoil further comprises the step of machining a cavity into each rotor blade airfoil.

3. A method in accordance with claim 1 further comprising the step of embedding a second layer of damping material within the airfoil cavity such that the constraining layer is between the first and second layers of damping material.

4. A method in accordance with claim 1 wherein said step of embedding a first layer of damping material further comprises the step of embedding a first layer of visco-elastic material within the airfoil cavity adjacent the airfoil.

5. A method in accordance with claim 1 wherein said step of attaching a cover sheet to the airfoil further comprises the step of attaching a cover sheet fabricated from titanium to the airfoil with adhesive.

6. A rotor assembly for a gas turbine engine, said rotor assembly comprising a rotor comprising a radially outer rim and a plurality of rotor blades extending radially outward from said radially outer rim, each said rotor blade comprising an airfoil and a damper system comprising at least one layer of damping material and a cover sheet, said cover sheet attached to said rotor blade airfoil with adhesive, each said rotor blade airfoil further comprising a first sidewall and a second sidewall, and a cavity therebetween, said cavity extending partially from a said first sidewall towards said second sidewall, said damping system cover sheet having an outer perimeter larger than an outer perimeter of said sidewall cavity.

7. A rotor assembly in accordance with claim 6 wherein said damping system cover sheet is configured to affix to said airfoil such that said sidewall cavity is sealed.

8. A rotor assembly in accordance with claim 6 wherein said damping material secured within said cavity by said cover sheet.

9. A rotor assembly in accordance with claim 6 wherein said damper system further comprises a constraining layer affixed to said airfoil with adhesive.

10. A rotor assembly in accordance with claim 6 wherein said damping material comprises visco-elastic material, said damping system comprises at least one constraining layer.

11. A rotor assembly in accordance with claim 10 wherein said constraining layer between adjacent damping material layers.

12. A gas turbine engine comprising a rotor assembly comprising a rotor comprising a radially outer rim and a plurality of rotor blades extending radially outward from said radially outer rim, each said rotor blade comprising an airfoil and a damper system comprising at least one layer of damping material and a cover sheet, said cover sheet attached to said rotor blade airfoil with adhesive such that said damping material is positioned between said airfoil and said damper system cover sheet, said damper system configured to damp vibrations induced to said rotor blades, each said rotor blade airfoil further comprising a first sidewall and a second sidewall, and a cavity therebetween, said cavity extending partially from a said first sidewall towards said second sidewall, said damping system cover sheet having an outer perimeter larger than an outer perimeter of said sidewall cavity.

13. A gas turbine engine in accordance with claim 12 wherein each said rotor assembly rotor blade airfoil comprises a first sidewall, a second sidewall, and a cavity extending radially inward from an exterior surface of said first sidewall, such that said cavity between said airfoil first and second sidewalls, said damper system damping material is positioned within said cavity.

14. A gas turbine engine in accordance with claim 13 wherein said rotor assembly damper system cover sheet affixed to said rotor assembly rotor blade airfoil with adhesive.

15. A gas turbine engine in accordance with claim 13 wherein said rotor assembly damper system further comprises at least one constraining layer affixed to said rotor assembly rotor blade airfoil with adhesive.

16. A gas turbine engine in accordance with claim 15 wherein said rotor assembly damper system constraining layer is positioned within said airfoil cavity between said damping material and said cover sheet.

17. A gas turbine engine in accordance with claim 15 wherein said rotor assembly damper system constraining layer is positioned within said airfoil cavity between a first layer of said damping material and a second layer of said damping material.

18. A gas turbine engine in accordance with claim 13 wherein said rotor assembly damper system damping material comprises visco-elastic material.

19. A gas turbine engine in accordance with claim 13 wherein said rotor assembly damper system cover sheet affixed to said airfoil in sealing contact around said airfoil cavity.

* * * * *